United States Patent [19]

Conti et al.

[11] 4,189,795

[45] Feb. 26, 1980

[54] TOILET FLUSH VALVE

[76] Inventors: Angelo J. Conti, 411 Lakewood Cir., Apt. B-915; Ira Pile, 411 Lakewood Cir., both of Colorado Springs, Colo. 80910

[21] Appl. No.: 943,880

[22] Filed: Sep. 20, 1978

[51] Int. Cl.[2] ..... E03D 1/14

[52] U.S. Cl. ..... 4/324; 4/394; 4/395; 4/403; 137/403; 251/206; 251/208

[58] Field of Search ..... 4/404, 403, 395, 378, 4/324, 394; 251/205, 206, 208; 137/403, 404

[56] References Cited

U.S. PATENT DOCUMENTS

| | | | |
|---|---|---|---|
| D. 248,313 | 6/1978 | Henry | D23/19 |
| D. 248,404 | 7/1978 | Henry | D23/19 |
| 1,057,654 | 4/1913 | Menzl | 137/403 |
| 1,223,799 | 4/1977 | Kitts | 137/404 |
| 1,233,684 | 7/1917 | Meyer et al. | 137/404 |
| 3,858,250 | 1/1975 | Coglitore | 4/67 |
| 3,955,218 | 5/1976 | Ramsey | 4/56 |

*Primary Examiner*—Houston S. Bell, Jr.
*Attorney, Agent, or Firm*—Young & Martin

[57] ABSTRACT

An improved ball valve for toilet flush tanks for regulating the quantity of water released from a tank in a flush includes a gauged or adjustable water inlet hole at the bottom of the ball valve and an air bleed hole at the top of the ball valve. The water inlet hole at the bottom of the ball valve is adjustable in size for selectively setting the flow rate of water entering the ball valve during a flush action, and thereby determining the time the ball valve remains open to allow flush water to drain from the tank.

13 Claims, 13 Drawing Figures

TOILET FLUSH VALVE

BACKGROUND OF THE INVENTION

The present invention is related generally to apparatus for controlling the outflow of flushing water from a toilet flush tank into a toilet bowl, and more particularly, to a ball valve for toilet flush tanks which tends to close before all of the water is drained from the flush tank during a flush.

Most conventional toilets of the type having a flush tank for storing water for use in flushing typically have a flush water volume capacity sufficient to satisfactorily flush solid matter, such as fecal waste, out of the toilet bowl. However, such capacity, while necessary for flushing solid waste, is excessive for normally flushing liquid waste, such as urine. Therefore, since the majority of flushes are used for flushing only liquid waste, an excessive amount of water is wasted during normal use over a period of time. Recent water shortages in several parts of the country, as well as a general increased awareness and concern for conservation has fostered searches for more effecient flushing or control devices for toilets to minimize the waste of water.

Most of the effort in developing more efficient toilet flushing devices has been directed to mechanisms which allow the user to select a flush utilizing the full capacity of the flush tank for flushing solid matter, or, in the alternative, utilizing only a portion of the water stored in the flush tank for flushing liquid waste. One of the more common approaches to solving the problem has been to provide dual drain outlets in the flush tank, with one outlet having a low elevation near the bottom of the flush tank, and the other outlet having a higher elevation in the range of midheight in the flush tank, each outlet having a separate ball valve mounted thereon that can be selectively opened by the operator, depending upon the amount of flush water desired. Typical of these inventions are the U.S. Pat. No. 2,505,091, invented by E. Brebis, U.S. Pat. No. 2,731,647, invented by E. Groth et al, U.S. Pat. No. 3,869,733, invented by C. White, U.S. Pat. No. 3,903,551, invented by A. Johnson, and U.S. Pat. No. 4,011,604, invented by F. Goldsworthy. While most of these inventions provide selective volume flush capabilities, most of them have several drawbacks. For example, flush tanks with conventional single volume flush mechanisms must be disassembled in order to be refitted with the dual capacity flush apparatus of these inventions, and relatively complex dual flush actuator and control mechanisms are required. Consequently, they are more expensive to to manufacture and they are very inconvenient for retrofitting existing single flush toilets with the dual flush mechanisms.

SUMMARY OF THE INVENTION

Accordingly, it is an object of the present invention to provide a novel and improved flushing mechanism that has dual capacity flush capability, yet is relatively simple, easy to install in new toilets as well as retrofitting old toilets equipped with conventional flush actuator mechanisms.

It is another object of the present invention to provide a toilet flush tank ball valve which closes automatically when only a portion of the water is drained from the flush tank and which can also be held open to allow all of the water to drain from the flush tank when a higher volume flush is desired.

Another object of the present invention is to provide a flush tank ball valve that can be adjusted to close automatically when a predetermined optimum amount of water is drained from the flush tank.

The improvement of the present invention in flush tank ball valves includes a ball valve with a hollow interior, an air bleed hole through the upper portion of the wall of the ball valve, and a water inlet hole at the bottom of the wall valve that is gauged to allow water to flow into the ball valve at a rate determined to cause the ball valve to become nonbuoyant and return to its closed position in the flush tank drain pipe opening when a preselected amount of water has drained from the flush tank into the toilet bowl. The water inlet opening at the bottom of the ball valve is preferably adjustable to accommodate setting of the ball valve closing time to adapt to the characteristics or requirements of individual toilet installations or operator requirements.

Several embodiments of adjustment mechanisms are included in the invention. One such embodiment includes a plurality of different sized holes in the bottom of the ball valve with a valve disc having one hole therethrough which can be rotated into alignment with any selected one of the several water inlet holes in the bottom of the ball valve. Another embodiment of the adjustment mechanism includes a single water inlet hole in the bottom of the ball valve with a rotatable ball cap positioned over the inlet hole and having a gauge hole through the cap eccentric to the inlet hole. A third embodiment includes a water inlet hole through the lower lateral wall of the ball valve and an axially slidable gauge sleeve positioned adjacent the water inlet hole. It is also contemplated that these adjustment mechanisms can be installed in the air bleed hole, rather than in the water inlet hole to vary the rate water can flow into the ball valve by controlling the rate at which the air is allowed to bleed out of the ball valve.

BRIEF DESCRIPTION OF THE DRAWINGS

Other objects, advantages, and capabilities of the present invention will become more readily appreciated and understood when taken together with the following detailed description, in conjunction with the accompanying drawings, in which.

DETAILED DESCRIPTION OF THE PREFERRED EMBODIMENT

Figure 1:
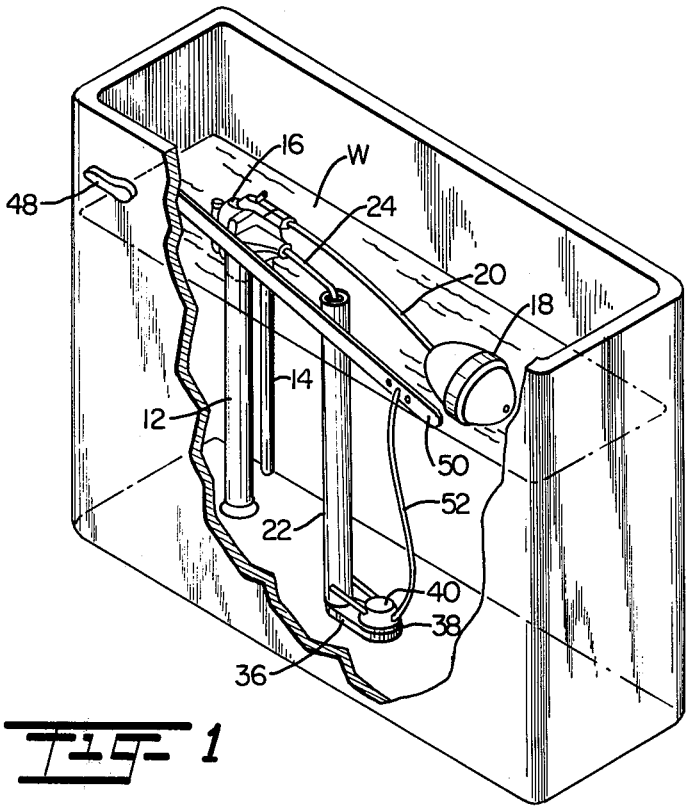
FIG. 1 is a perspective view of a toilet flush tank equipped with the improved ball valve of the present invention.

The present invention is an improvement in ball valves for toilet flush tanks, and it is designed for installation in a toilet flush tank in a conventional manner. For purposes of background description to enhance understanding of this invention, a conventional toilet flush apparatus is shown in FIG. 1, including a flush tank 10 having a water inlet tube 12 extending vertically upward from the bottom of the flush tank 10, and a water valve 16 mounted on top of the water inlet tube 12. The valve 16 controls water introduced into the flush tank 10, and a fill tube 14 extends downwardly from the valve 16 to direct the fill water from the valve 16 to the bottom of the flush tank 10. The valve 16 is controlled by a float 18 connected to the valve 16 by rod 20 such that when the water W in the flush tank reaches a predetermined full elevation level in the tank 10, the float 18 will cause the valve 16 to close. The conventional toilet also has a drain pipe 26 through its bottom, which allows water W to drain from the flush tank 10 into the toilet when the drain pipe 26 is open to effect the desired flushing. A ball valve is typically positioned over the opening 38 of the drain pipe 26 for opening and closing the drain pipe 26, and a maximum of water level overflow tube 22 is connected to the drain pipe 26 by an enclosed chamber 38 under the ball valve so it is always open. The overflow tube extends upwardly from the chamber 38 to the maximum water level elevation in the flush tank 10. The float 18 and rod 20 are usually set to close valve 16 just before the water level in the tank 10 rises to the top of the overflow tube 22. A drip to 24 connected to the valve empties into the overflow tube 22. A conventional ball valve, which is well known in the art, is usually hollow with an open bottom and is removably seated in the opening 38 of the drain pipe 26 to prevent water W in the flush tank 10 from flowing out. The ball valve is pivotally attached to the overflow tube 22 by brackets 42, and it is connected to lever 50 by a flexible strap or chain 52. A handle 48 through the front wall of the flush tank allows a user to raise the lever 50.

In conventional flush operation, the user manually pushes handle 48 downwardly, causing lever 50 to raise. The flexible strap or chain 52 pulls the ball valve out of the opening 38 allowing the water to flow through the drain pipe 26 into the toilet bowl for flushing. Air trapped inside the ball valve makes the ball valve buoyant, thereby causing it to remain open until the water W in the flush tank 10 is substantially drained out. When the water 10 is drained out of the flush tank, the ball valve falls by gravity back into its closed position seated in the opening 38 of the drain pipe 26. The flush tank 10 is then refilled with water W through the fill tube 14 for the next flushing.

Figure 4:
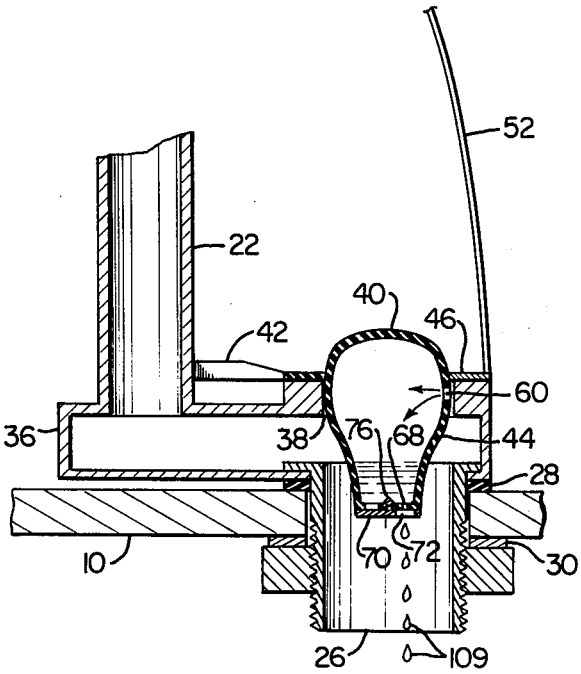
FIG. 4 is a cross-sectional view similar to FIG. 3, but with the improved ball valve in the closed or non-flushing position.
Figure 3:
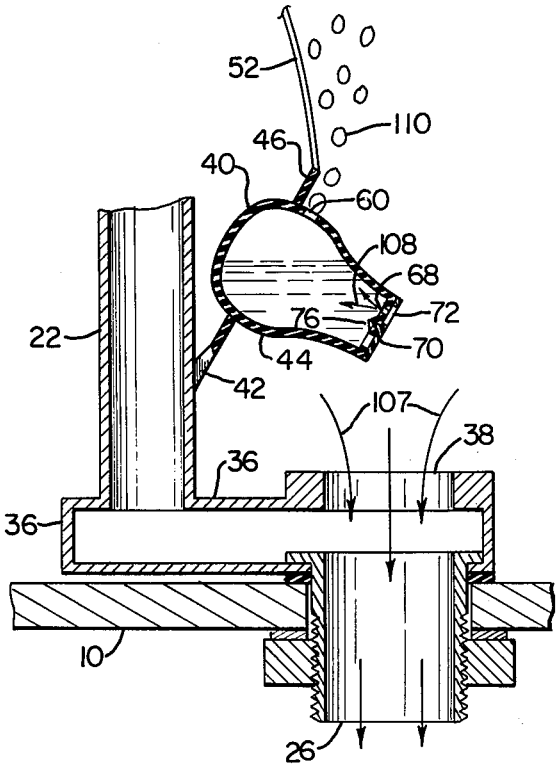
FIG. 3 is a cross-sectional view of the improved ball valve installation with the ball valve in open position for flushing.
Figure 5:
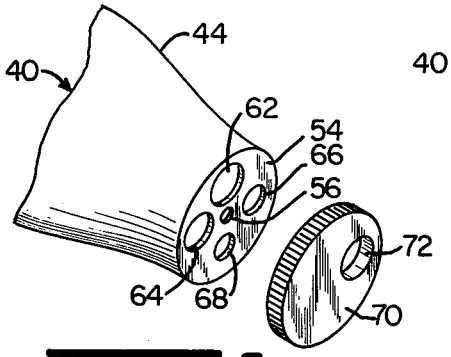
FIG. 5 is an enlarged, exploded perspective view of the preferred embodiment of the water inlet hole adjustment mechanism at the bottom of the improved ball valve.
Figure 6:
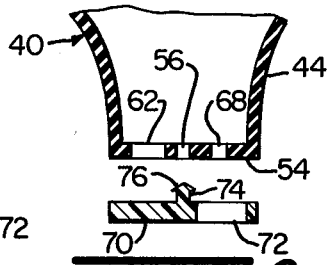
FIG. 6 is a cross-sectional exploded view of the preferred embodiment of the adjustment mechanism.
Figure 2:
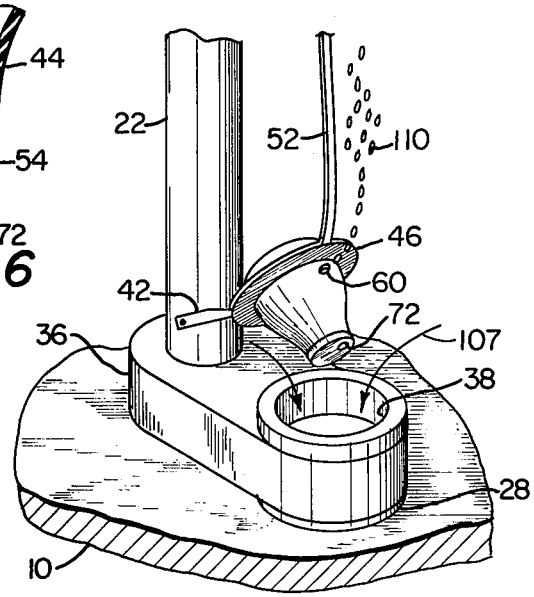
FIG. 2 is an enlarged perspective view of the improved ball valve installed in a conventional toilet with the ball valve shown in its open position during flushing.

The improved ball valve 40 of the present invention is best illustrated in FIGS. 2, 3 and 4. In FIGS. 2 and 3, the improved ball valve 40 is shown in its open position as water from the flush tank flows downwardly through the drainpipe 26 as indicated by arrows 107. The ball valve 40 has a hollow bulb portion 44 and an annular rim 46 around its upper portion. An air bleed hole 60 is provided in the upper portion of the ball valve 40 just under the annular rim 46. The hollow bulb portion 44, as also illustrated in FIGS. 5 and 6, has a closed end wall 54 at its bottom end with a plurality of different sized water inlet holes 62, 64, 66, 68 therethrough with their respective centers positioned on the circumference of a common circle.

A valve disc 70 is positioned over the end wall 54 for sealing or closing off the inlet holes 62, 64, 66, 68. The valve disc 70 has a valve hole 72 therethrough also centered on the circumference of the common circle with the centers of the inlet holes 62, 64, 66, 68, such that when the valve hole 72 is aligned with one of the inlet holes, water is allowed to flow therethrough into the bulb portion 44 of the ball valve 40. The valve disc 70 is rotatably mounted on the end enclosure 54 by an axle 74 inserted in an axle mounting hole 56 positioned at the center of the common circle in the end wall 54. The axle 74 is retained in mounting hole 56 by an enlargement 76 on the distal end of the axle 74. The axle 74 and enlargement 76 are preferably fabricated of a resilient material such as rubber or plastic which can be forced through the hole 56.

It can be appreciated therefore that when the ball valve is pulled open, as shown in FIGS. 2 and 3, and the valve hole 72 in valve disc 70 is aligned with one of the water inlet holes 62, 64, 66, 68, water can flow through the holes into the interior of the ball valve 40 as the air in the interior of the ball 40 escapes through bleed hole 60. The flow rate of the water flowing into the ball valve 40 can be regulated by selecting the preferred water inlet hole size from the several water inlet holes 62, 64, 66, 68 by aligning the valve hole 72 with the selected water inlet hole. The diameter of the valve hole 72 should be larger than the diameter of the second largest water inlet hole, and ideally it should be at least as large in diameter as the largest of the water inlet holes.

In a flushing operation, as best seen in FIGS. 2 and 3, the valve is lifted by flexible strap 52 attached to the lever 50 and handle 48 in the conventional manner as described above. When the ball valve 40 is lifted out of the drainpipe opening 38, the water begins to flow downwardly and out of the flush tank 10 through drainpipe 38. In the meantime, water also begins immediately to flow at the desired preselected rate into the interior of the ball valve 40 through the valve hole 72 and inlet hole 68, as indicated by arrows 108, the air inside the ball valve 40 escapes through the air bleed hole 60, as indicated by bubbles 110. When a sufficient amount of water has entered the ball valve 40 so that the ball valve 40 is no longer buoyant, it falls back into the drainpipe opening 38 with rim 46 seating thereon and stopping any further flow of water from the flush tank 10. In contrast to a conventional ball valve which closes only when substantially all the water is drained from the tank 10, the improved ball valve 40 of this invention closes when a substantial amount of water is still in the flush tank 10, whenever the ball valve 40 is no longer buoyant.

As indicated above, the valve disc 70 can be set to control the rate of flow of water into the ball valve 40 to result in the ball valve 40 becoming no longer buoyant when the preferred amount of water W has been allowed to flow out of the flush tank 10 for a sufficient flush for liquid waste. However, if a full flush is desired, such as for flushing solid waste, the user maintains his hold on the flush actuator handle 48 to retain the ball valve in its open position through a full flush until the entire contents of water in the flush tank 10 is allowed to drain through the drainpipe 26.

When the flush is completed with the ball valve 40 returned to its closed position, as shown in FIGS. 1 and 4, the rim 46 seats on the peripheral surface of the drain pipe opening 38, prohibiting any more water from flowing out of the flush tank 10. The water in the interior of the ball valve 40 then drains out through the hole 68 and valve hole 72 into the drain pipe 26 as air flows back into the ball valve 40 through hole 60. Preferably all of the water should drain out of the ball valve 40 in less time than it takes for the flush tank 10 to be refilled, so the ball valve 40 is ready for another flush whenever the tank 10 is full.

Figure 8:
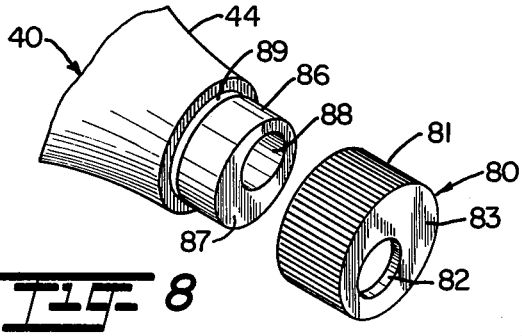
FIG. 8 is an exploded view of the adjustment mechanism of FIG. 7.
Figure 10:
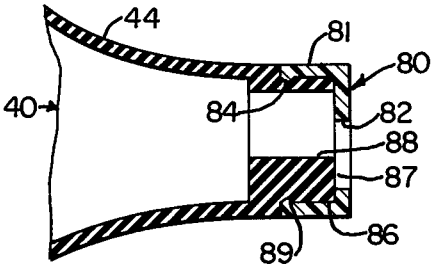
FIG. 10 is a cross-sectional view of the assembled adjustment mechanism of the first alternate embodiment shown in FIG. 7.
Figure 9:
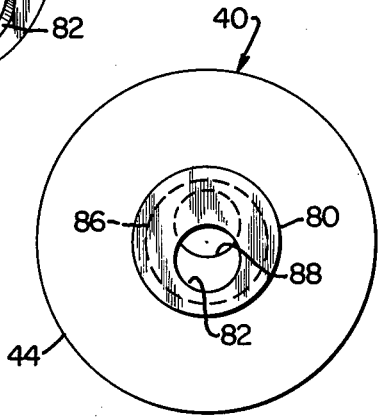
FIG. 9 is a bottom plan view of the adjustment mechanism of the first alternate embodiment shown in FIG. 7.
Figure 7:
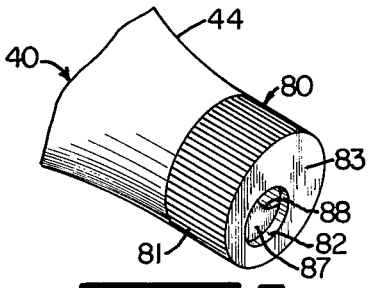
FIG. 7 is an enlarged perspective view of a first alternate embodiment of the water inlet hole adjustment mechanism at the bottom of the ball valve.

An alternative embodiment of the improved ball valve 40 has a different adjustment valve mechanism. As best seen in FIGS. 7 through 9, the bottom portion of the ball valve 40 has a cylindrical protrusion 86 extending axially therefrom with an end wall enclosure 87 and a water inlet hole 88 therethrough. The water inlet hole 88 is offset from the axial center of the end wall enclosure 87. A cylindrical rotatable cap 80 with sidewalls 81 of sufficient diameter to just slip over the protrusion 86 of the ball valve 40 is provided with an end wall enclosure 83 and a valve hole 82 therethrough eccentric to the axis of the cap 80. When the valve cap 80 is positioned over the protrusion 86 at the bottom of the ball valve 40 as shown in FIGS. 7, 9, and 10, it can be rotated so that the eccentric hole 82 is either fully or partially aligned with the water inlet hole 88. It can be appreciated that a slower rate of flow of water can be allowed to flow into the ball valve 40 when the valve hole 82 and inlet hole 88 are only partially aligned than when they are fully aligned. Therefore, the user can adjust the flow rate of water into the ball valve 40 by merely rotating the valve cap 80 so that the desired quantity of water draining from the flush tank for a partial flush is obtained. The protrusion 86 also has an annular groove 89 around its peripheral surface, and the cap 80 includes an annular bead 84 around the inside surface of the cylindrical wall 81 for engaging with the annular groove 89 to retain the cap 80 in position on the protrusion 86 while allowing rotation of the cap 80. The cap 80 is preferably fabricated of a resilient rubber or plastic material so that the bead 84 can be forced over the cylindrical wall of the protrusion 86 to the groove 89 during assembly.

Figure 11:
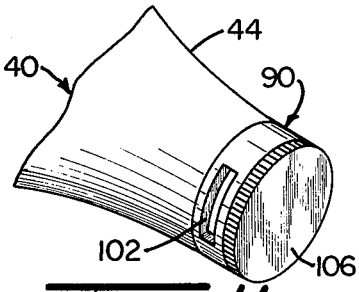
FIG. 11 is an enlarged perspective view of a second alternate embodiment of the water inlet adjustment mechanism at the bottom of the ball valve.
Figure 12:
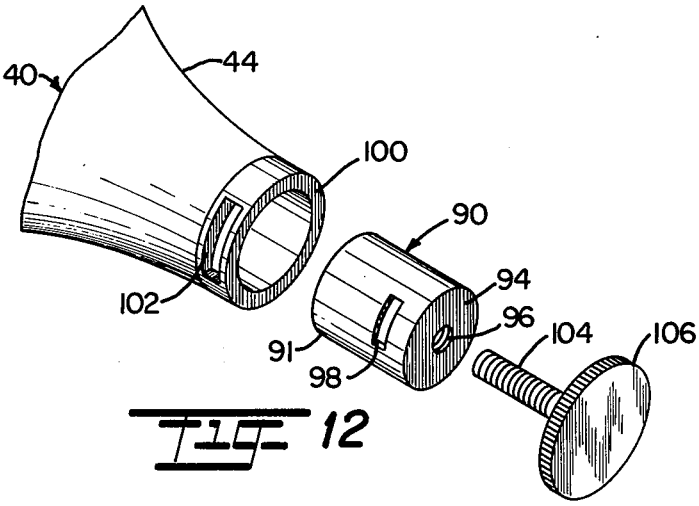
FIG. 12 is an exploded view in perspective of the adjustment mechanism of the second alternate embodiment shown in FIG. 11.
Figure 13:
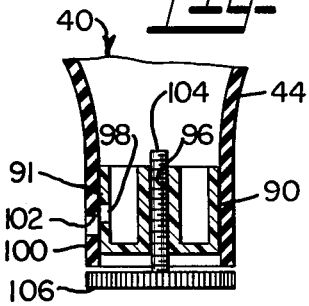
FIG. 13 is a cross-sectional view of the assembled adjustment mechanism of the second alternate embodiment shown in FIG. 11.

A second alternative embodiment of the ball valve 40 has still another adjustment valve mechanism. As best seen in FIGS. 11 through 13, adjustment valve mechanism of this invention includes a cylindrical sleeve 90, comprised of a cylindrical wall 91 and an end wall enclosure 94, which is slidable in position inside the cylindrical end wall 100 of the ball valve. The end wall 100 has a slotted hole 102 extending diametrically therethrough, and the sleeve 90 also has a similar slotted hole 98 therethrough. When the sleeve 90 is positioned in the end 100 of ball valve 40, as shown in FIG. 13, the valve hole 98 is slidable into and out of alignment with the water inlet hole 102. An adjusting screw 104 with an enlarged head 106 is screwed into a threaded hole 96 in the end wall enclosure 94 of the sleeve 90 for slidably adjusting the sleeve 90 to the appropriate position to obtain the desired flow rate of water into the interior of the ball valve to effect the desired volume of flushing water as described above.

Although not shown in the drawings, the above-described adjustment mechanisms can also be used for the air bleed hole 60, or a plurality of air bleed holes, rather than for the water inlet holes. When the adjustment mechanisms are installed in this manner, they can be used to selectively restrict the flow rate of air escaping the ball valve 40, and thereby also controlling the flow rate of water entering the ball valve 40 through the water inlet opening. While a ball valve equipped with such adjustment mechanisms on the air bleed hole functions to cause a low volume flush as contemplated by this invention, it has been found that direct control of the flow of water into the ball valve rather than indirect control of the water flow rate by controlling the escaping air is preferable for accurate and maintenance free operation.

Although the present invention has been described with a certain degree of particularity, it is understood that the present disclosure has been made by way of example, and that changes in detail of structure may be made without departing from the spirit thereof.

What is claimed is:

1. In flush valve apparatus for toilets for controlling water flow from the toilet flush tank to the toilet bowl, which apparatus includes a drain opening in the bottom of the flush tank and a hollow ball valve with a substantially enclosed chamber therein and an opening in the bottom portion thereof to the exterior of the ball valve, wherein said hollow ball valve is movably positioned over the drain opening in the toilet flush tank for selectively opening the drain and closing the drain to the flow of water out of said flush tank, and wherein said ball valve is buoyant in water in the flush tank when said chamber is substantially filled with air and displaced upwardly from said drain opening, the improvement comprising:

an air bleed hole extending through the upper portion of the ball valve near its upper extremity from the chamber to the exterior of the ball valve and the opening in the bottom extremity of the ball valve being gauged to allow water in the flush tank to flow into said ball valve at a predetermined rate to displace the air in the chamber when said ball valve is displaced upwardly from said drain opening to decrease the buoyancy of said ball valve at a rate sufficient to allow the force of gravity to overcome the buoyancy of said ball valve and cause the ball valve to move downwardly to seat in the drain opening when a preselected amount of water has flowed out of the drain opening.

2. In flush valve apparatus for toilets for controlling water flow from the toilet flush tank to the toilet bowl, which apparatus includes a drain opening in the bottom of the flush tank and a hollow ball valve with a substantially enclosed chamber therein and an opening in the bottom portion thereof to the exterior of the ball valve, wherein said hollow ball valve is movably positioned over the drain opening in the toilet flush tank for selectively opening the drain and closing the drain to the flow of water out of said flush tank, and wherein said ball valve is buoyant in water in the flush tank when said chamber is substantially filled with air and displaced upwardly from said drain opening, the improvement comprising:

an air bleed hole extending through the upper portion of the ball valve near its upper extremity from the chamber to the exterior of the ball valve, and flow rate adjustment means across said opening in the bottom extremity of said ball valve for selectively adjusting the flow rate of water flowing into said ball valve through said opening to displace the air in the chamber when the ball valve is displaced upwardly from said ball valve at a rate sufficient to allow the force of gravity to overcome the buoyancy of said ball valve and cause the ball valve to move downwardly to seat in the drain opening when a preselected amount of water has flowed out of the drain opening.

3. The improvement in flush valve apparatus of claim 2, wherein said flow rate adjustment means includes a plurality of inlet holes in the lower extremity of said ball valve, each of said inlet holes being of different diameter than the others and centered on the circumference of a common circle, and a rotatable selector valve rotatably mounted at the center of said circle over said inlet holes, said selector valve having one hole therethrough centered in axial alignment with the circumference of said circle such that said one hole in said valve is rotatable to alternative positions in respective alignment with a selected one of said inlet holes while closing the remaining of said inlet holes to allow water to flow through the selected one of said inlet holes into said ball valve, said hole in said selector valve being larger in diameter than the second largest of said inlet holes.

4. The improvement in flush valve apparatus of claim 3, wherein said ball valve has an attachment hole therein at the center of said circle, and said selector valve has an axially protruding attachment member extending therefrom with a resilient enlargement at its distal end adapted for insertion through said attachment hole such that said enlargement resists retraction of said attachment member from said attachment hole while accommodating rotation of said selector valve in relation to said ball valve.

5. The improvement in flush valve apparatus of claim 2, wherein said flow rate adjustment means includes an inlet hole in the lower extremity of said ball valve and a rotatable valve cap over the lower extremity of said ball valve that has a hole therethrough in eccentric relation to the axis of rotation of said valve cap and to said inlet hole.

6. The improvement in flush valve apparatus of claim 2, wherein said flow rate adjustment means includes an inlet hole in the sidewall of said ball valve near the lower extremity thereof, and an adjustably slidable valve sleeve positioned in the bottom extremity of said ball valve adjacent said inlet hole with a valve hole therethrough positioned to move into and out of alignment with said inlet hole as said valve sleeve is slidably moved in relation to said ball valve.

7. The improvement in flush valve apparatus of claim 6, including an axial threaded hole in said sleeve and an adjusting screw screwed into said threaded hole that has an enlarged head which bears against the lower extremity of the sidewall of said ball valve for adjustably moving said sleeve axially into and out of said ball valve.

8. In flush valve apparatus for toilets for controlling water flow from the toilet flush tank to the toilet bowl, which apparatus includes a drain opening in the bottom of the flush tank and a hollow ball valve with a substantially enclosed chamber therein and an opening in the bottom portion thereof to the exterior of the ball valve, wherein said hollow ball valve is movably positioned over the drain opening in the toilet flush tank for selectively opening the drain and closing the drain to the flow of water out of the flush tank, and wherein said ball valve is buoyant in water in the flush tank when said chamber is substantially filled with air and displaced upwardly from said drain opening, including a sealing surface near the upper extremity of the ball valve adapted for seating in the drain pipe of the flush tank when it is in closed position, the improvement comprising:

an air bleed hole extending through the upper portion of the ball valve near its upper extremity from the chamber to the exterior of the ball valve and under said sealing surface, and flow rate adjustment means on said air bleed hole for selectively adjusting the flow rate of air out of said ball valve.

9. The improvement in flush valve apparatus of claim 8, wherein said flow rate adjustment means includes a plurality of bleed holes in the upper extremity of said ball valve and under said sealing surface, each of said bleed holes being of different diameter than the others and centered on the circumference of a common circle, and a rotatable selector valve rotatably mounted at the center of said circle over said bleed holes, said selector valve having one hole therethrough centered in axial alignment with the circumference of said circle such that said one hole in said valve is rotatable to alternative positions in respective alignment with a selected one of said bleed holes while closing the remaining of said bleed holes to allow air to escape through the selected one of said bleed holes into said ball valve, said hole in said selector valve being larger in diameter than the second largest of said inlet holes.

10. The improvement in flush valve apparatus of claim 9, wherein said ball valve has an attachment hole therein at the center of said circle, and said selector valve has an axially protruding attachment member extending therefrom with a resilient enlargement at its distal end adapted for insertion through said attachment hole such that said enlargement resists retraction of said attachment member from said attachment hole while accommodating rotation of said selector valve in relation to said ball valve.

11. The improvement in flush valve apparatus of claim 8, wherein said flow rate adjustment means includes a laterally extending protrusion with a bleed hole therein protruding from the upper extremity of said ball valve under said sealing surface, and a rotatable valve cap over the protrusion that has a hole therethrough in eccentric relation to the axis of rotation of said valve cap and to said bleed hole.

12. The improvement in flush valve apparatus of claim 8, wherein said flow rate adjustment means includes a laterally extending protrusion extending from the sidewall of said ball valve near the upper extremity thereof and under said sealing surface, a bleed hole in the sidewall of said protrusion, and an adjustably slidable valve sleeve positioned in the protrusion adjacent said bleed hole with a valve therethrough positioned to move into and out of alignment with said bleed hole as said valve sleeve is slidably moved in relation to said protrusion.

13. The improvement in flush valve apparatus of claim 12, including an axial threaded hole in said sleeve and an adjusting screw screwed into said threaded hole that has an enlarged head which bears against the outer extremity of said protrusion for adjustably moving said sleeve axially into and out of said protrusion.

* * * * *